US007434280B2

(12) United States Patent
Cyr

(10) Patent No.: US 7,434,280 B2
(45) Date of Patent: Oct. 14, 2008

(54) BED ENCLOSURE

(76) Inventor: Patrick C. Cyr, 112 New York St., Millinocket, ME (US) 04462

( * ) Notice: Subject to any disclaimer, the term of this patent is extended or adjusted under 35 U.S.C. 154(b) by 324 days.

(21) Appl. No.: 11/439,650

(22) Filed: May 24, 2006

(65) Prior Publication Data

US 2007/0271698 A1 Nov. 29, 2007

(51) Int. Cl.

| | |
|---|---|
| ***A47C 29/00*** | (2006.01) |
| *A47G 5/00* | (2006.01) |
| *A47D 7/00* | (2006.01) |
| *A47D 13/06* | (2006.01) |
| *E06B 3/30* | (2006.01) |
| *E06B 9/24* | (2006.01) |
| *E06B 9/00* | (2006.01) |
| *E04H 15/34* | (2006.01) |

(52) U.S. Cl. ..... 5/414; 5/512; 5/93.1; 5/98.1; 160/380; 160/371; 160/352; 135/121

(58) Field of Classification Search ..... 5/98.1, 5/97, 93.1, 424, 425, 285, 286, 414, 512, 5/201; 135/116, 96, 121, 157; 160/369, 160/371, 377, 380, DIG. 18, 135
See application file for complete search history.

(56) References Cited

U.S. PATENT DOCUMENTS

| | | | | |
|---|---|---|---|---|
| 1,056,712 | A | 3/1913 | Schweda | |
| 3,165,760 | A | 1/1965 | Abajian | |
| 4,641,387 | A | 2/1987 | Bondy et al. | |
| 5,384,925 | A | 1/1995 | Vail | |
| 6,256,813 | B1 * | 7/2001 | Aaron | 5/93.1 |
| 6,263,529 | B1 | 7/2001 | Chadwick et al. | |
| 6,694,547 | B1 | 2/2004 | Vail | |
| 7,047,991 | B2 * | 5/2006 | Kline | 135/96 |
| 7,062,806 | B2 * | 6/2006 | Merlin | 5/93.1 |

OTHER PUBLICATIONS

Vail Enclosed Bed System Oct. 7, 2005 www.vailbed.com/bedsystems_test.html.

"Pedicraft Canopy Beds" Oct. 7, 2005 www.pedicraft.com/canopybeds.html.

"NewCare Bed Enclosures" Oct. 7, 2005 www.newcaretherapies.com/enclosedbeds.html.

* cited by examiner

*Primary Examiner*—Patricia L Engle
*Assistant Examiner*—Jonathan J Liu
(74) *Attorney, Agent, or Firm*—Anthony D. Pellegrini, Esq.

(57) ABSTRACT

A bed enclosure having a frame, four sidewalls, and a mattress support component suitable for supporting a bed mattress, wherein the bed enclosure is adapted to safely retain within its interior a person who may be prone to falling out of bed or who otherwise may need to be restrained therein, with the bed enclosure having component subframes that can be disassembled for ease of use and storage and sidewalls that can be removed for ease of cleaning, repair, or replacement.

4 Claims, 6 Drawing Sheets

BED ENCLOSURE

BACKGROUND OF THE INVENTION

1. Technical Field

The invention relates generally to bed enclosures and more particularly to bed enclosures intended for use with persons who are prone to falling out of bed or who otherwise may need to be restrained in bed. Such bed enclosures are typically used in health care settings for persons with physical or mental disabilities. They are an improvement over bodily restraints that might otherwise be used to prevent injury.

2. Description of Prior Art

Persons with multiple mental or physical disabilities may have difficulty sleeping in a standard bed. They may not make safe choices and could thus be prone to injury. They may attempt to leave the bed when they are not physically able to safely do so, resulting in falls, or they may leave the bed and wander about, unsupervised, resulting in the possibility of becoming involved in dangerous situations. They may also be prone to self-destructive behavior, such as head banging or flailing about, leading to injury. Consequently, the need to create a safe sleeping environment is a priority for persons with mental or physical disabilities.

Bed enclosures for restraining the users are well known in the art. These include cage-like bed enclosures completely surrounding the bed, with means for entering and exiting the enclosures. These are typically complicated, permanent, expensive devices. Often the enclosures have mechanical positioning devices to raise or lower the bed, as is commonly found in hospital beds. While such devices address the principal goals of providing a safe sleeping environment, they lack the simplicity of construction, inexpensive manufacturing costs, ease of cleaning and repair, and ease of storage.

It is therefore an objective of this invention to provide an improved bed enclosure which safely restrains a person within its interior.

It is a further objective of this invention to provide an improved bed enclosure which is easy to assemble and disassemble for ease of storage and shipping.

It is yet a further objective of this invention to provide an improved bed enclosure which is easy to clean and repair.

It is yet a further objective of this invention to provide an improved bed enclosure which is easy and cost efficient to manufacture.

SUMMARY

The invention is directed to an improved bed enclosure which safely restrains a person within its interior while also being easy to assemble and disassemble for ease of storage and shipping, as well as easy to clean and repair and cost efficient to manufacture.

The bed enclosure of the present invention is designed with safety in mind. It is for the young child or adult with disabilities who would not be safe in a standard bed. It provides a safe environment to those who are prone to head-banging, wandering, or making unsafe decisions. Many children with cognitive disabilities such as autism and mental retardation do not sleep well and tend to wander or get into unsafe situations. In many bedrooms the windows, heating systems, electrical outlets, and even the furniture pose a risk to these children in the absence of a safe sleep system.

The bed enclosure's inside corner padding helps to minimize injury from jumping, falling, or head-banging. The manner in which the frame and mattress come together helps to eliminate the probability of a person "burrowing" or getting caught between the mattress and the surrounding material. The way the bed is constructed also eliminates the possibility of any child with a pica disorder (e.g., tendency to eat non-food items) of contacting and chewing any of the frame.

Another important aspect of the bed enclosure is that it allows the caregiver to know exactly where the child or adult is, in the event of a fire or emergency. Many children or confused adults might hide during a fire and be at risk. With the bed enclosure of the present invention a caregiver knows exactly where to find the child.

The bed enclosure has a frame comprised of removable subframes, removable flexible sidewalls, a mattress support component, and an access mechanism for accessing the interior of the bed enclosure, operable from the exterior. The four subframes are removably attached to each other by an attachment component which also serves to removably attach each of the sidewalls independently to the frame. The removable sidewalls are suitably adapted to cover all portions of the frame accessible from the interior. This protects the user from the hard surfaces of the frame.

The preferred configuration of the attachment component comprises small apertures placed through and aligned among the sidewalls, the subframes, and the mattress support component, and fasteners suitably adapted to be placed into and through the aligned apertures. Edges of the sidewalls are placed between elements of the subframes and mattress support component, such that the edges of the sidewalls are sandwiched between the rigid subframes and mattress support component and secured in place by the fasteners. So configured, the bed enclosure may be easily disassembled for storage or shipping. The sidewalls may similarly be easily removed for cleaning, repair, or replacement. They also may comprise mesh portions to provide airflow through the interior of the bed enclosure and to provide visual access. The bed enclosure may be constructed of inexpensive materials, such as dimensioned lumber and canvas.

Other features and advantages of the invention are described below.

DESCRIPTION OF DRAWINGS

FIG. 4A is a side view of the present invention, depicting in detail the relationship of various elements of the mattress support component.

FIG. 4B is an exploded side view of the present invention, depicting the relationship of elements of the subframe, the mattress support component, and the sidewall.

FIG. 4C is a side view of the present invention, depicting in detail the relationship of the cross piece of the mattress support component to the subframe and the attachment component.

DETAILED DESCRIPTION OF THE INVENTION

Figure 1:
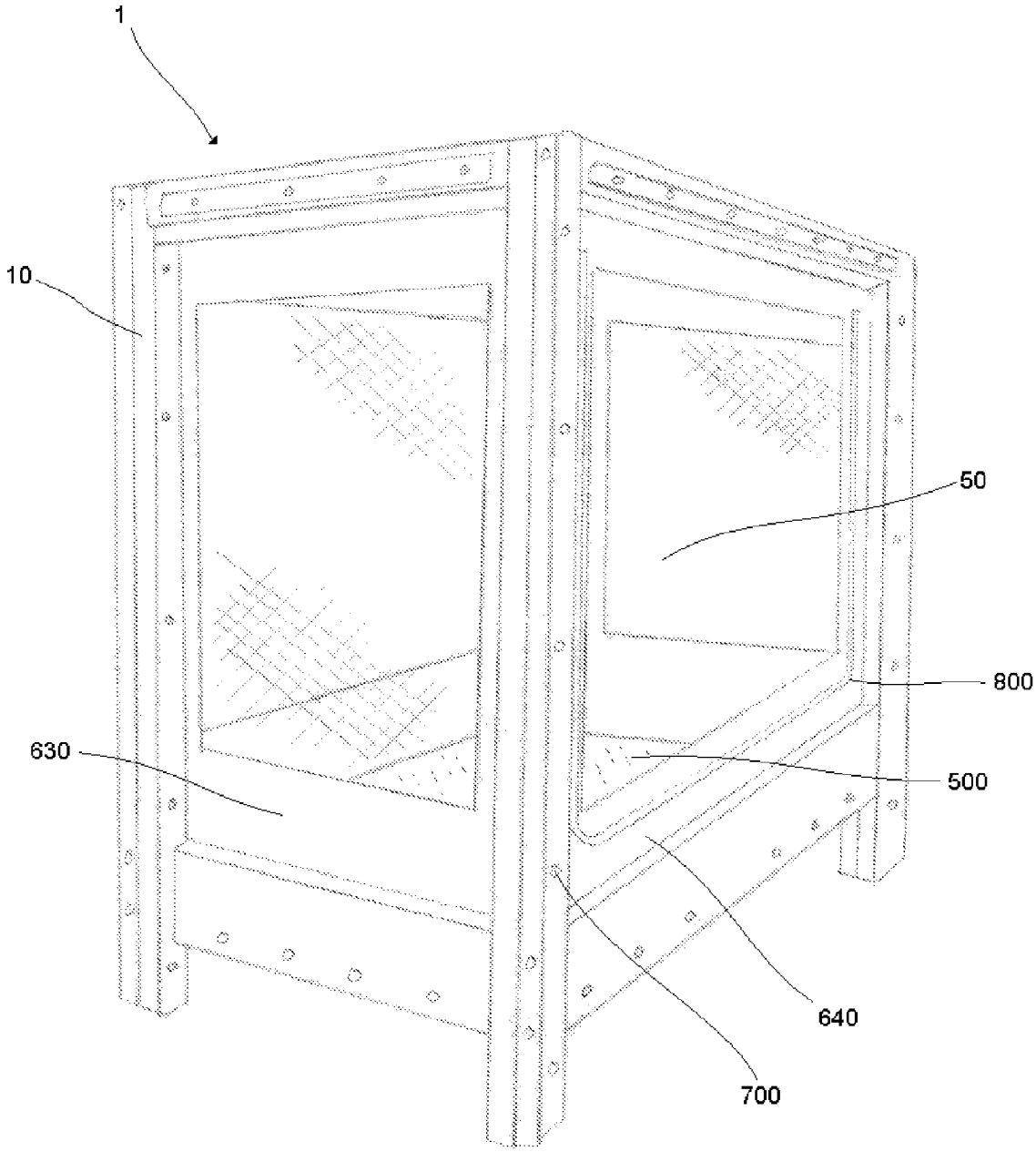
FIG. 1 is a perspective view of the present invention.

The bed enclosure 1 of the present invention is comprised of a frame 10, a mattress support component 500 supported by the frame 10, four sidewalls 610,620,630,640, each removably attached to the frame 10, and an access mechanism 800 to access the interior of the bed enclosure 1. See FIG. 1.

The frame 10, mattress support component 500, and four sidewalls 610,620,630, 640 define a sleeping space 50, with the sleeping space 50 formed by and partially enclosed by the frame 10, sidewalls 610,620,630,640, and mattress support component 500. The bottom of the sleeping space 50 is defined by the mattress support component 500 and the sides of the sleeping space 50 are defined by the four sidewalls 610,620,630,640. The top of the sleeping space 50 is left open. A bed mattress 5 is placed within the sleeping space 50 upon the mattress support component 500. This configuration provides sufficient restraint to the user without presenting an overly restrictive sleeping environment, such as with an enclosed top.

Figure 6:
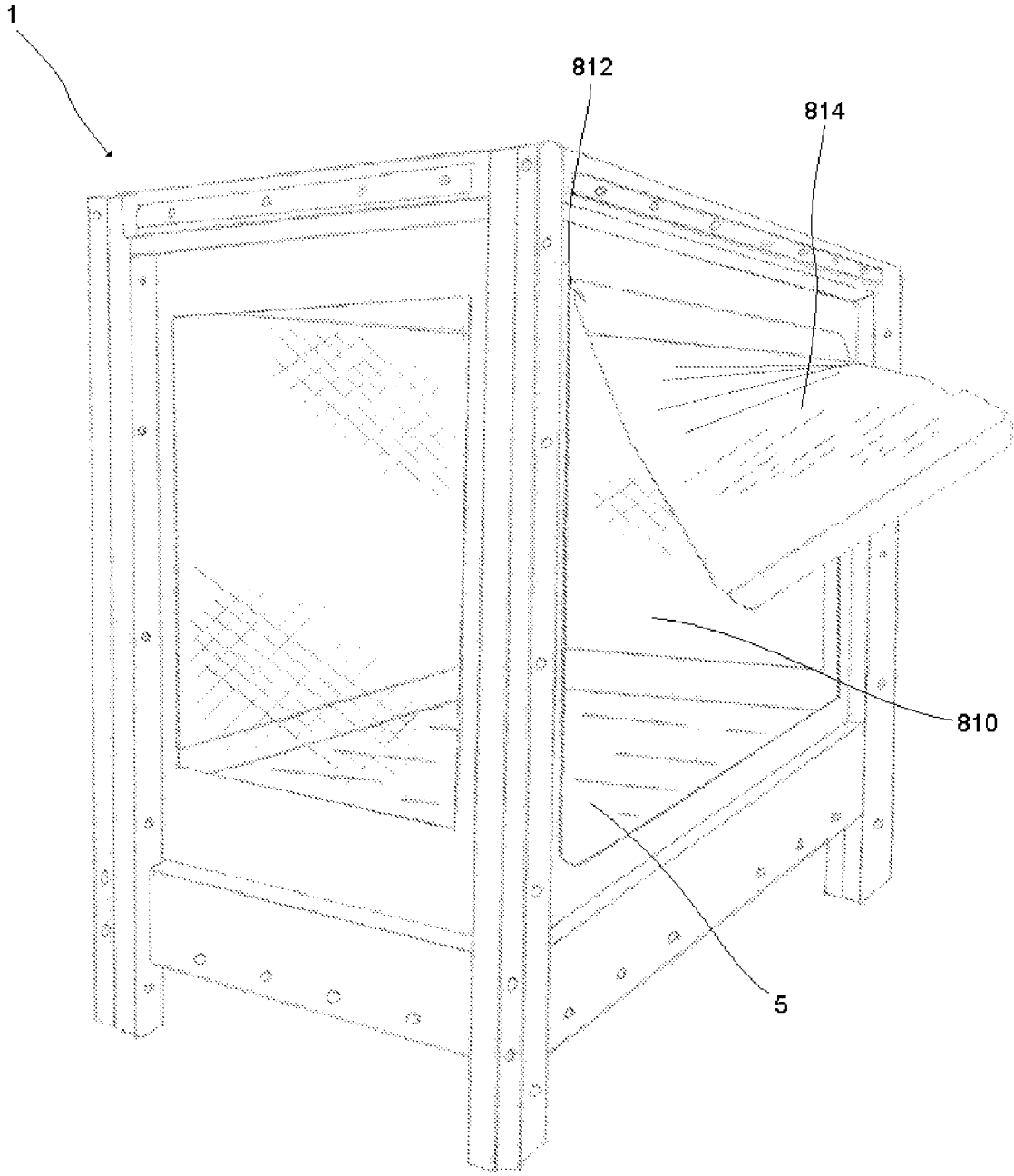
FIG. 6 is a perspective view of the present invention, depicting the access mechanism.

The access mechanism 800 is integrated into at least one sidewall and comprises at least one closable aperture 810. See FIG. 6. Each closable aperture 810 has an open state and a closed state, whereby the closable aperture 810 allows a person to access and to enter into or exit the sleeping space 50 when the closable aperture 810 is in the open state and prevents a person from accessing or entering into or exiting the sleeping space 50 when the closable aperture 810 is in the closed state. Maintaining the closable aperture 810 in the closed state when a person is in the sleeping space 50 retains that person within the sleeping space 50. So arranged, a person may comfortably rest upon a bed mattress 5 within the sleeping space 50 without risk of falling off the bed mattress 5 or out of the bed enclosure 1, and without risk of improper wandering.

The state of each closable aperture 810 of the access mechanism 800 is controlled from the exterior of the sleeping space 50. In one embodiment the access mechanism 800 of the present invention further comprises a zipper 812 associated with each closable aperture 810 and a flap 814. Each closable aperture 810 thus may be opened and closed by operation of its associated zipper 812 to free or secure the flap 814. Each closable aperture 810 is in the open state when its associated flap 814 is freed and in the closed state when its associated flap 814 is secured. The flap 814 may further be rolled up and out of the way when it is in the opened state, secured in place by straps, to expose the interior of the sleeping space 50. This is useful when training a user to sleep without restraints, for example when transitioning to a standard bed, as well as for accessing the sleeping space 50 for cleaning purposes. In another embodiment the flap 814 of each closable aperture 810 is formed of a mesh material.

Because the four sidewalls 610,620,630,640 are removable, they can be taken off the frame 10 for easy cleaning, repair, or replacement. The sidewalls 610,620,630,640 may be constructed of different materials, though a flexible material is preferred. This offers protection to the person using the bed enclosure 1, so that a fall against a sidewall does not lead to injury. In one embodiment the sidewalls 610,620,630,640 are constructed of heavy duty canvas. In the preferred embodiment at least a portion of at least one of the sidewalls is constructed of a mesh material. This permits easy viewing into and out of the sleeping space 50 as well as improved airflow. In the most preferred embodiment the sidewall opposite a sidewall having at least a portion constructed of a mesh material or having a mesh flap 814 integrated therein would also have at least a portion constructed of a mesh material, thereby further increasing airflow through the sleeping space 50. Another embodiment utilizes an opaque panel that can cover or uncover the mesh portion of a sidewall. The panel may be attached to the sidewall proximate to the top of the sidewall and rolled up and out of the way, secured by straps, to expose the interior of the sleeping space 50, and unrolled to cover the sidewall to provide privacy.

The bed enclosure 1 of the present invention may further comprise padding 680 located within the sleeping space 50 at each inside corner of the frame 10, and along the frame structure itself. See FIG. 3. The presence of padding 680 increases the safety of the bed enclosure 1 in that no hard surfaces are exposed to the person within the sleeping space 50. The padding 680 may be made of high density foam and covered in a washable, durable material, such as canvas. Other materials may also be used for the padding 680. In the preferred embodiment the padding 680 is removable for cleaning and replacement purposes. In the most preferred embodiment the padding 680 is attached to the sidewalls 100,200,300,400 by Velcro®.

The frame 10 of the bed enclosure 1 of the present invention may be constructed of any suitable rigid material, such as metal or rigid plastic. In the preferred embodiment the frame 10 is constructed of wood, specifically dimensioned lumber. The frame 10 is designed to be modular, facilitating assembly and disassembly, and allowing for convenient storage requiring a minimum of space when the bed enclosure 1 is not in use. See FIG. 2. As such, the frame 10 comprises a head subframe 100, a foot subframe 200, a first side subframe 300, and a second side subframe 400. The foot subframe 200 is substantially the same size and shape as the head subframe 100 and located opposite and substantially parallel to the head subframe 100. The first side subframe 300 is attached substantially perpendicular to both the head subframe 100 and the foot subframe 200, and has a width greater than the width of either the head or foot subframes 100,200. The second side subframe 400 is substantially the same size and shape as the first side subframe 300 and located opposite and substantially parallel to the first side subframe 300. The second side subframe 400 is also attached substantially perpendicular to both the head subframe 100 and the foot subframe 200. The four subframes are removably attached to each other as described below by the attachment component 700.

Figure 2:
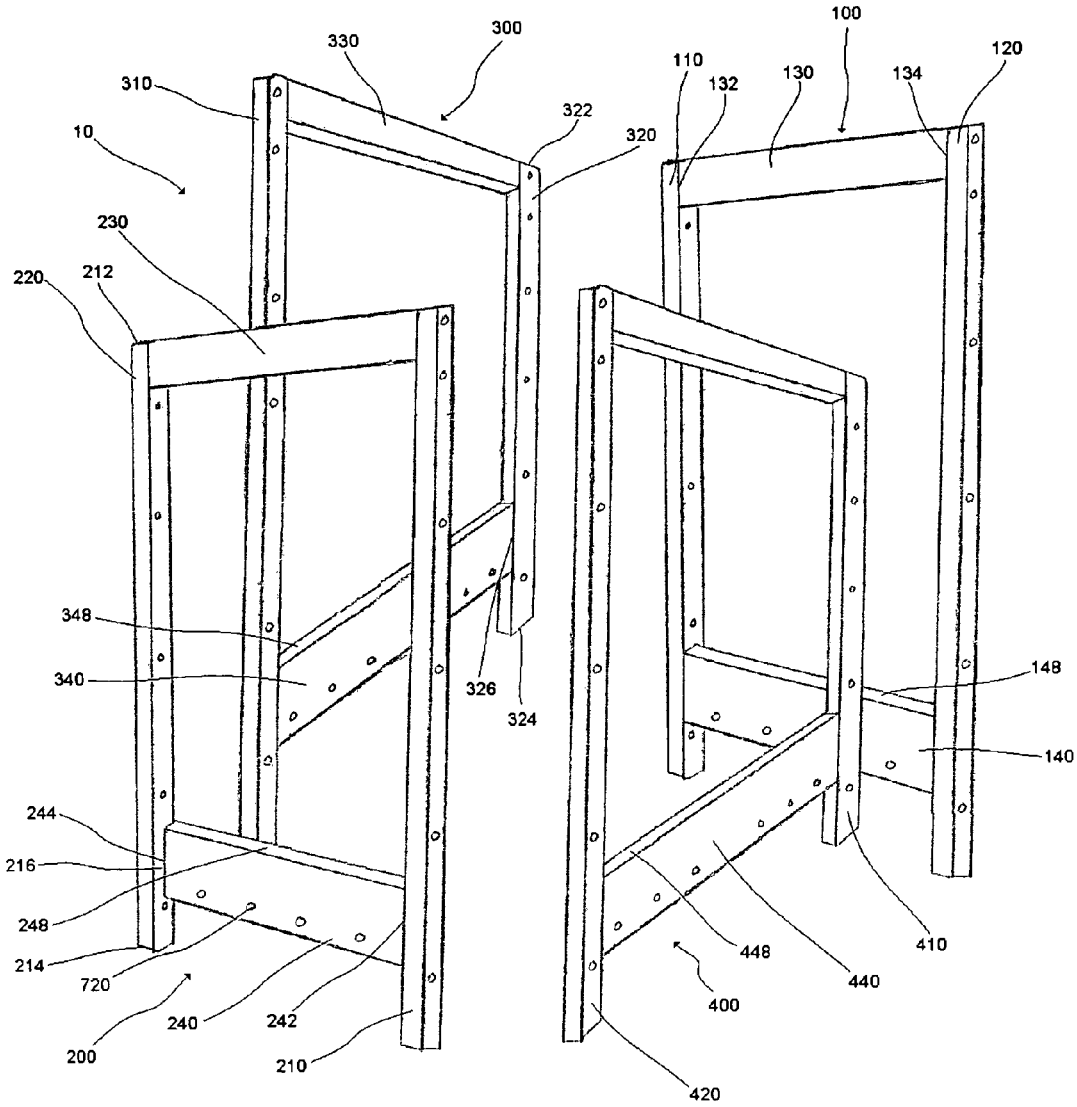
FIG. 2 is an exploded view of the frame of the present invention, depicting the structure of the four subframes.

FIG. 2 shows the subframes 100,200,300,400 in detail. Each of the subframes 100,200,300,400 shares the same basic configuration, a modified "H"-frame with an extra horizontal piece across the top. The "legs" of each subframe are designated the first vertical support member and the second vertical support member. The top piece is designated the upper horizontal support member, and the cross piece of the "H" is designated the lower horizontal support member.

The upper end 212 of the first vertical support member 110,210,310,410 of each subframe is fixedly attached to the first end 132 of the upper horizontal support member 130, 230,330,430, and the upper end 322 of the second vertical support member 120,220,320,420 is fixedly attached to the second end 134 of the upper horizontal support member 130, 230,330,430. The first end 242 of the lower horizontal support member 140,240,340,440 is fixedly attached to the first vertical support member 110,210,310,410 at a point located between upper end 212 and the lower end 214 of the first vertical support member 110,210,310,410, this point, designated the connection point 216, being closer to the lower end 214 of the first vertical support member 110,210,310,410 than to its upper end 212. The second end 244 of the lower horizontal support member 140,240,340,440 is fixedly attached to the second vertical support member 120,220, 320,420 at a point 326 located between the upper end 322 and the lower end 324 of the second vertical support member 120,220,320, 420, corresponding to the same location as the connection point 216 on the first vertical support member 110,210,310,410. For each of the subframes, the top edges 148,248,348,448 of the lower horizontal support members 140,240,340,440 are substantially the same distance from the lower ends 214,324 of the vertical support members 110,120, 210,220,310,320,410,420 as for the other subframes, resulting in the top edges 148,248,348,448 of the horizontal support frames lying substantially within the same horizontal plane when the subframes are attached to each other by the attachment component 700.

In the preferred embodiment the first vertical support member 110,210,310,410 and the second vertical support member 120,220,320,420 of each subframe are substantially the same height, and the upper horizontal support member 130,230,330,430 and the lower horizontal support member 140,240,340,440 of each subframe are substantially the same length. This allows the vertical support members 110,120, 210,220,310,320,410,420 to be oriented substantially parallel to each other, the horizontal support members 130,140, 230,240,330,340, 430,440 to be oriented substantially parallel to each other, and the vertical support members 110, 120,210,220,310,320,410,420 to be oriented substantially perpendicularly to the horizontal support members 130,140, 230,240,330,340,430,440. In the most preferred embodiment the vertical support members 110,120,210,220,310,320,410, 420 of all subframes are substantially the same height, while the horizontal support members 130,140,230,240 of the head and foot subframes 100,200 are substantially the same length and the horizontal support members 330, 340,430,440 of the first side and second side subframes 300,400 are substantially the same length and longer than the horizontal support members 130,140,230,240 of the head and foot subframes 100, 200.

Figure 5:
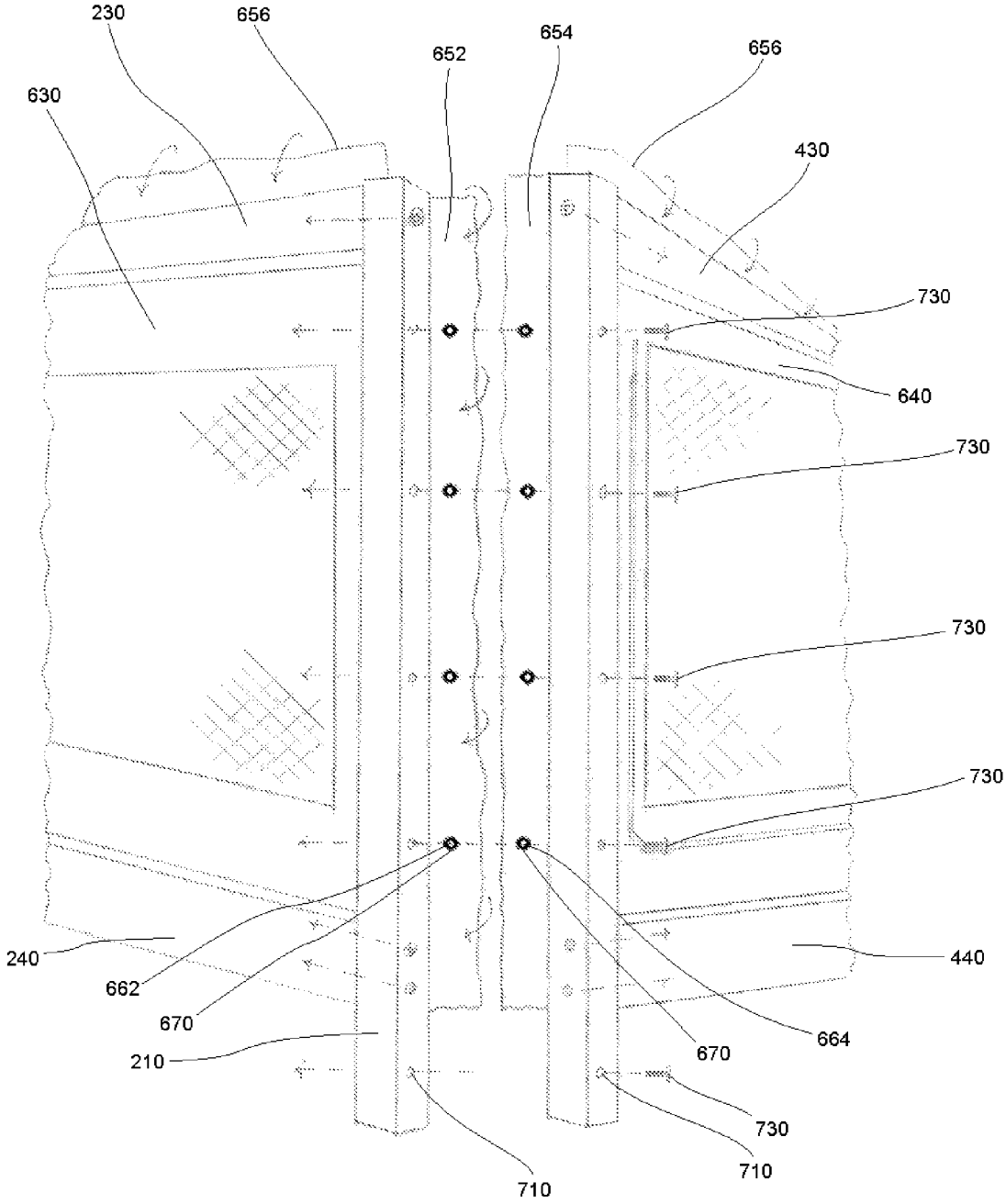
FIG. 5 is a perspective view of one corner of the present invention, depicting the attachment component and the relationship of the sidewalls thereto.

The attachment component 700 of the present invention is suitably adapted to allow the subframes to be securely attached to each other when the bed enclosure 1 is in use and detached from each other so the bed enclosure 1 may be stored away or shipped. In one embodiment, shown in FIG. 5, the attachment component 700 comprises a plurality of side apertures 710 and a plurality of side fasteners 730. The side apertures 710 are formed through the vertical support members 110,120,210,220,310,320,410,420 of each of the subframes. Each of the side apertures 710 is oriented substantially perpendicular to the longitudinal axis of the vertical support member into which it is formed, and has a substantially cylindrical inside diameter. The side apertures 710 formed into adjacent vertical support members of adjacent subframes are aligned with each other; for example, side apertures 710 formed into the first vertical support member 110 of the head subframe 100 are aligned with corresponding side apertures 710 formed into the second vertical support member 320 of the first side subframe 300. So configured, each pair of aligned side apertures 710 forms a single continuous passage through the adjacent pair of vertical support members. The pairs of side apertures 710 formed into the first vertical support member 110 of the head subframe 100 and the second vertical support member 320 of the first side subframe 300 are collectively designated first corner apertures, the pairs of side apertures 710 formed into the first vertical support member 310 of the first side subframe 300 and the second vertical support member 220 of the foot subframe 200 are collectively designated second corner apertures, the pairs of side apertures 710 formed into the first vertical support member 210 of the foot subframe 200 and the second vertical support member 420 of the second side subframe 400 are collectively designated third corner apertures, and the pairs of side apertures 710 formed into the first vertical support member 410 of the second side subframe 400 and the second vertical support member 120 of the head subframe 100 are collectively designated fourth corner apertures.

The plurality of side fasteners 730 are suitably adapted to be positioned at least partially within the corner apertures. In the preferred embodiment each side fastener 730 comprises a shaft 732, a retaining member 734, and a securing member 736. The shaft 732 has a first end and a second end, and the diameter of the shaft 732 is just slightly smaller than the inside diameters of the corner apertures, thus permitting the shaft 732 of the side fastener 730 to be inserted into the corner apertures. The retaining member 734 of the shaft 732 is substantially planar and fixed to the first end of the shaft 732 in a substantially perpendicular orientation to the longitudinal axis of the shaft 732. The surface area of the retaining member 734 is greater than the inside diameters of the corner apertures, such that the retaining member 734 cannot be drawn into or through the corner apertures. The securing member 736 of the shaft 732 is substantially planar and removably attachable to the second end of the shaft 732, in a substantially perpendicular orientation to the longitudinal axis of the shaft 732. The surface area of the securing member 736 is also greater than the inside diameters of the corner apertures, such that the securing member 736 cannot be drawn into or through the corner apertures. In this embodiment, a side fastener 730 is positioned within an aligned pair of corner apertures by first removing the securing member 736 from the shaft 732, inserting the second end of the shaft 732 into and through the pair of corner apertures until the second end of the shaft 732 is exposed and the retaining member 734 is positioned flush against the first of the pair of vertical support members, and then replacing the securing member 736 onto the second end of the shaft 732 such that the securing member 736 is positioned flush against the second of the vertical support members. So positioned, the side fastener 730 holds together the pair of vertical support members, with the retaining member 734 of the side fastener 730 preventing the shaft 732 from pulling through the pair of corner apertures in one direction, and the securing member 736 of the side fastener 730 preventing the shaft 732 from pulling through the pair of corner apertures in the opposite direction. The side fasteners 730 may be removed from the corner apertures by removing their securing members 736 from their shafts 732 and then withdrawing the side fasteners 730.

In the preferred embodiment the retaining members 734 of the side fasteners 730 are countersunk flush into the vertical support members and the securing members 736 of the side fasteners 730 are countersunk flush into the other vertical support members. In the most preferred embodiment the side fasteners 730 are connector bolts having securing caps. Other configurations of side fasteners 730 are also contemplated by the present invention, for example traditional bolts and nuts.

Figure 3:
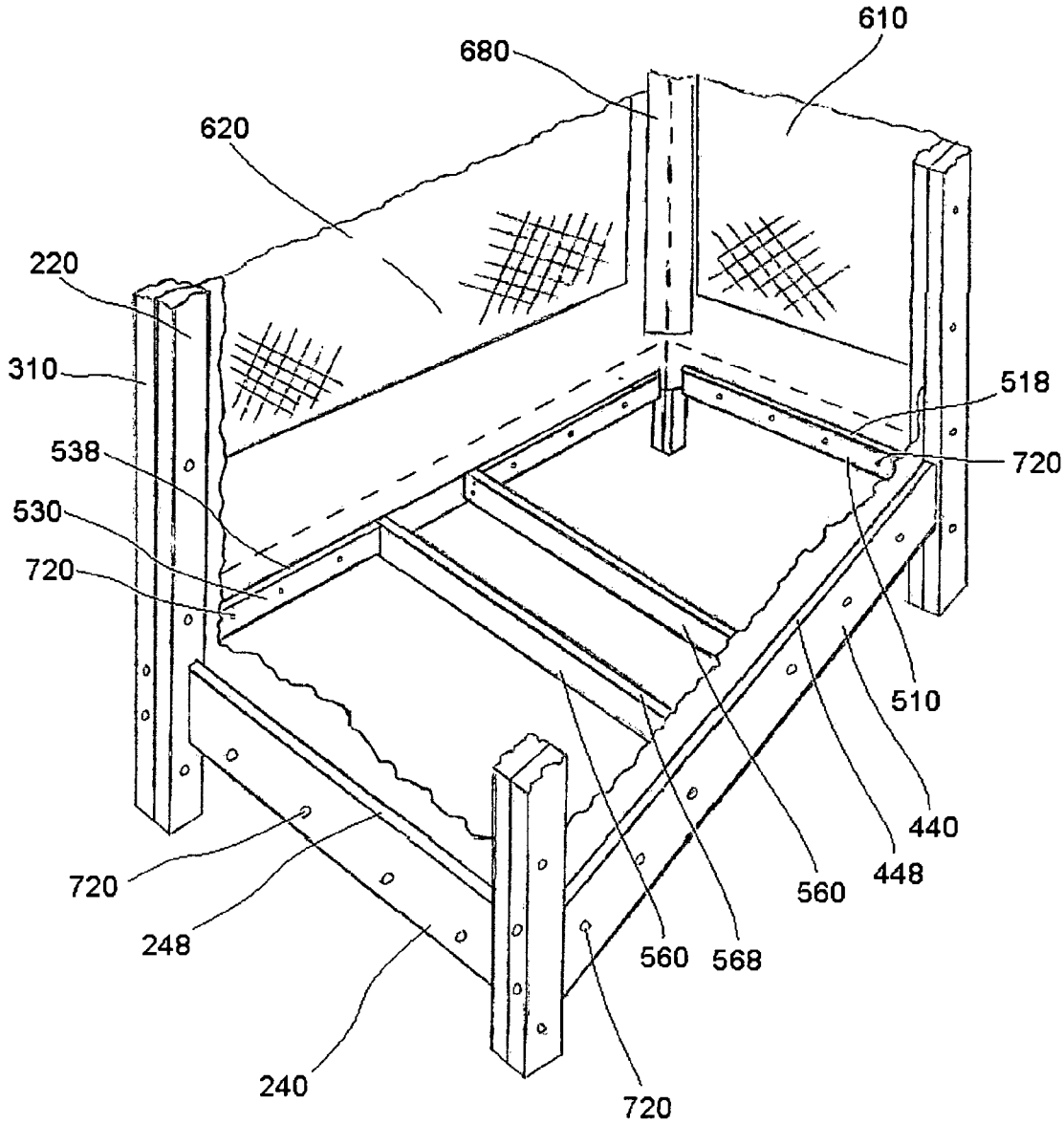
FIG. 3 is a cut-away perspective view of the present invention, depicting the structure of the mattress support component.
Figure 4:
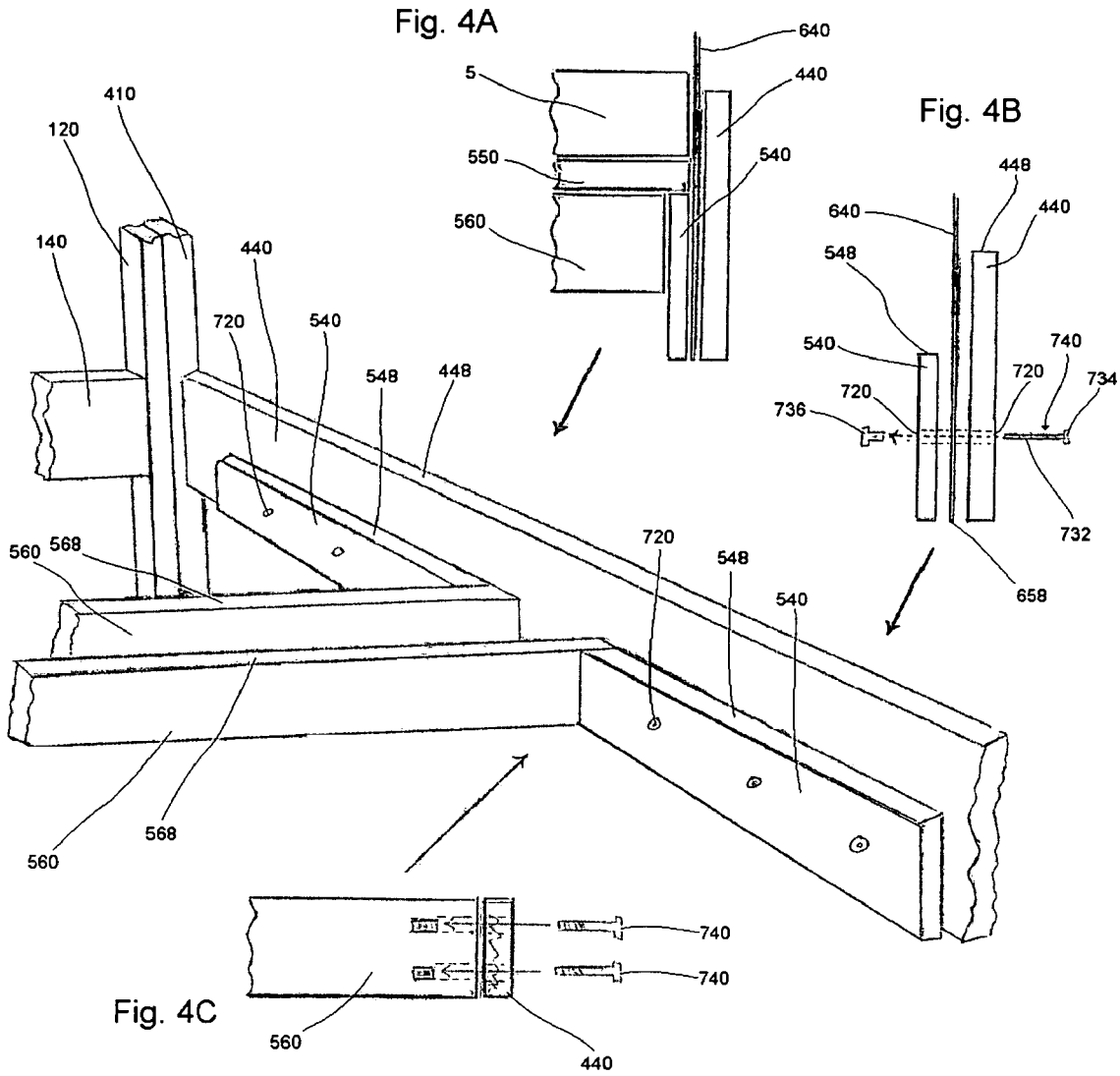
FIG. 4 is a perspective view of a portion of the mattress support component, depicting the embodiment designed to address "burrowing".

The mattress support component 500 of the bed enclosure 1, shown in FIGS. 3 and 4, is suitably adapted to support a bed mattress 5. The mattress support component 500 may be constructed of any suitable rigid material, such as metal or rigid plastic. In the preferred embodiment it is constructed of wood, specifically dimensioned lumber. In one embodiment the mattress support component 500 is comprised of lateral members 510,530,540 secured in a substantially horizontal orientation to the lower horizontal support members 140,240, 340,440 of the subframes 100,200,300,400 on the interior portions of the subframes 100,200,300,400, and a mattress support surface 550 which is placed onto the lateral members 510,530,540. In the preferred embodiment the lateral members 510,530,540 each are substantially elongate and substantially planer and have a substantially uniform thicknesses and atop edge 518,538,548. See FIG. 3. There is a head support member 510, a foot support member, a first side support member 530, and a second side support member 540. The top edges 518,538,548 of the lateral support members lie substantially within a single horizontal plane. The mattress support surface 550 is substantially planar and has a width just slightly less than the length of the lower horizontal support member 140 of the head subframe 100. It is placed onto at least a portion of the top edges 518,538,548 of at least two of the lateral support members, for example onto the top edge 538 of the first side support member 530 and the top edge 548 of the second side support member 540. In other embodiments there may be multiple mattress support surfaces 550, placed on the top edges 518,538,548 of lateral support members and lying within a single substantially horizontal plane. The use of multiple mattress support surfaces 550 allows each to be smaller and thus easier to manipulate. In the preferred embodiment each of the plurality of mattress support components 500 extends from the top edge 538 of the first side support member 530 to the top edge 548 of the second side support member 540.

The mattress support component 500 may further comprise at least one cross piece 560, with each cross piece 560 being substantially elongate and substantially planer and having a substantially uniform thickness, a top edge 568, a first end, and a second end. See FIG. 3. Each cross piece 560 is secured between the first side subframe 300 and the second side subframe 400 and with its top edge 568 oriented upwards and in a plane with the top edges 518,538,548 of the lateral support members. The first end of each cross piece 560 is secured to the first side support member 530. Similarly, the second end of each cross piece 560 is secured to the second side support member 540. Each cross piece 560 is oriented substantially parallel to the head support member 510. The mattress support surface 550 is placed onto at least a portion of the top edge 568 of at least one cross piece 560. When the mattress support component 500 is configured with one or more cross pieces 560 the mattress support surface 550 is better supported from below, strengthening the bed enclosure 1. In another embodiment there may be a plurality of lateral support members 510,530,540 secured to each lower horizontal support member 140,240,340,440. This permits the use of shorter lateral support members 510,530,540 and allows for gaps between the lateral support members located on a given lower horizontal support member, to accommodate the ends of the cross pieces 560. In this configuration the first end of each cross piece 560 is secured directly to the lower horizontal support member 340 of the first side subframe 300 between adjacent first side support members 530, and the second end of each cross piece 560 is secured directly to the lower horizontal support member 440 of the second side subframe 400 between adjacent second side support members 540.

In the preferred embodiment the lateral support members are positioned relative to the lower horizontal support members 140,240,340,440 of the subframes 100,200,300,400 such that the top edges 518,538,548 of the lateral support members are positioned below the top edges 148,248,348, 448 of the lower horizontal support members 140,240,340, 440. See FIGS. 4, 4A, and 4B. The height of the portions of the lower horizontal support members 140,240,340, 440 of the subframes 100,200,300,400 which extend above the top edges 518,538,548 of the lateral support members 510,530, 540 is less than the thickness of the bed mattress 5. This configuration addresses the problem of "burrowing", in which a user of the bed enclosure 1 either intentionally or inadvertently places a portion of his or her body between the side of the bed mattress 5 and a side wall. This could occur when the top edges 518,538,548 of the lateral support members are positioned in substantially the same plane as the top edges 148,248,348,448 of the lower horizontal support members 140,240,340,440 of the subframes 100,200 300 400, such that the sides of the bed mattress 5 are proximate to the flexible sidewalls 610,620,630,640. An application of force to the region of proximity between the side of the bed mattress 5 and a sidewall may cause a space to open there between, potentially entrapping a body part and leading to serious harm to the user. With the lower horizontal support members 140, 240,340,440 of the subframes 100,200,300,400 configured as described, a substantial portion of the bed mattress 5 lies below the top edges 148,248,348,448 of the lower horizontal support members 140,240,340, 440 so that the lower portions of the sides of the bed mattress 5 are proximate to a rigid structure, thereby minimizing the amount of space that can be opened between the sides of the bed mattress 5 and the lower horizontal support members 140,240,340,440. Having the height of the portions of the lower horizontal support members 140,240,340,440 which extend above the top edges 518, 538,548 of the lateral support members 510,530,540 less than the thickness of a bed mattress 5 allows the top portion of the sides of the bed mattress 5 to extend above the rigid structure, reducing the possibility of contact by the user with a hard surface. See FIG. 4A. In the most preferred embodiment the height of the portions of the lower horizontal support members 140, 240,340,440 which extend above the top edges 518,538,548 of the lateral support members 510,530,540 should be just slightly less than the thickness of the bed mattress 5 when the bed mattress 5 is fully compressed.

The above-described elements of the mattress support component 500 may be fixedly secured to the subframes or removably secured to the subframes. In one embodiment the mattress support component 500 is removably secured to the subframes by a plurality of bottom fasteners 740 placed within bottom apertures 720 formed into and through the lateral support members and the lower horizontal support members 140,240,340,440 of the subframes 100,200, 300, 400. See FIG. 4C. Bottom apertures 720 are disposed along the lower horizontal support member 140 of the head subframe 100 and along the head support member 510 such that the bottom apertures 720 of the head subframe 100 align with the bottom apertures 720 of the head support member 510. In a like manner bottom apertures 720 are disposed long the lower horizontal support members 240,340,440 of the other subframes 200,300,400 and aligned with bottom apertures 720 disposed along the other lateral support members. Each aligned pair of bottom apertures 720 is oriented substantially perpendicular to the longitudinal axis of the lower horizontal support member 140,240,340,440 or lateral support member into which it is formed, and has a substantially cylindrical inside diameter. So configured, each pair of aligned bottom apertures 720 forms a single continuous passage through the corresponding adjacent lower horizontal support member and lateral support member. The bottom fasteners 740 may be configured similarly to the side fasteners 730 of the attachment component 700.

In the preferred embodiment, the sidewalls 610,620,630, 640 are removably secured to the frame 10 by the attachment component 700. In this embodiment, each sidewall has a first vertical edge 652, a second vertical edge 654, a top edge 656, a bottom edge 658, a plurality of first edge apertures 662 located proximate to the first vertical edge 652, and a plurality of second edge apertures 664 located proximate to the second vertical edge 654. See FIG. 5. The first edge apertures 662 of the first sidewall 610 are aligned with the first corner apertures of the attachment component 700 and the second edge apertures 664 of the first sidewall 610 are aligned with the fourth corner apertures. The first edge apertures 662 of the second sidewall 620 are aligned with the second corner apertures and the second edge apertures 664 of the second sidewall 620 are aligned with the first corner apertures. The first edge apertures 662 of the third sidewall 630 are aligned with the third corner apertures and the second edge apertures 664 of the third sidewall 630 are aligned with the second corner apertures. The first edge apertures 662 of the fourth sidewall 640 are aligned with the fourth corner apertures and the second edge apertures 664 of the fourth sidewall 640 are aligned with the third corner apertures. The first sidewall 610 is secured to the frame 10 by placing its first vertical edge 652 between the first vertical support member 110 of the head subframe 100 and the second vertical support member 320 of the first side subframe 300 such that the side fasteners 730 placed within the first corner apertures pass through the first edge apertures 662 of the first sidewall 610, and by placing the second vertical edge 654 of the first sidewall 610 between the second vertical support member 120 of the head subframe 100 and the first vertical support member 410 of the second side subframe 400 such that the side fasteners 730 placed within the fourth corner apertures pass through the second edge apertures 664 of the first sidewall 610. In a similar manner the first and second edges 652,654 of the remaining sidewalls 620,630,640 are placed between pairs of vertical support members 110,320,120,410,420,210,220,310, with side fasteners 730 passing through the edge apertures 662,664 of the sidewalls 620,630,640. The sidewalls 610,620,630, 640 may further comprise a plurality grommets 670, with the grommets 670 located within the edge apertures 662,664, one grommet 670 per aperture 662,664. This strengthens the stress points between the side fasteners 730 and the edge apertures 662,664 and creates a more durable sidewall. Thus, the edges 652,654,656,659 of the sidewalls 610,620,630, 640 are sandwiched between pairs of vertical support members 110,320,120,410,420,210,220, 310, with the side fasteners 730 placed through the edge apertures 662,664 to prevent slippage. This configuration allows the sidewalls 610,620, 630,640 to be very securely attached to the frame 10, yet easily removed simply by removing the side fasteners 730 and separating the subframes. In yet another embodiment the vertical support members 110,120,210,220,310,320, 410,420 may comprise indentations on their adjacent surfaces at the edge apertures 662,664 to accommodate the grommets 670, allowing an even tighter fit between the subframes.

In another embodiment of the present invention, the top edge 656 of the first sidewall 610 is removably attached to the upper horizontal support member 130 of the head subframe 100, the top edge 656 of the second sidewall 620 is removably attached to the upper horizontal support member 330 of the first side subframe 300, the top edge 656 of the third sidewall 630 is removably attached to the upper horizontal support member 230 of the foot subframe 200, and the top edge 656 of the fourth sidewall 640 is removably attached to the upper horizontal support member 430 of the second side subframe 400. The top edges 656 of the sidewalls 610,620,630,640 may also be wrapped over and around the upper horizontal support members 130,230,330,430 of the subframes 100,200,300, 400. See FIG. 5. There may further be a plurality of top edge apertures located proximate to the top edge 656 of each sidewall 610,620, 630,640, through which may be placed top fasteners. This creates a tighter fit of the sidewalls 610,620, 630,640 to the frame 10.

In yet another embodiment, the bottom edges 658 of the first sidewall 610, the second sidewall 620, the third sidewall 630, and the fourth sidewall 640 are removably attached to the lower horizontal support members 140,340,240,440 of the head subframe 100, the first side subframe 300, the foot subframe 200, and the second side subframe 400, respectively. In one configuration, the first sidewall 610 has a plurality of bottom edge apertures located proximate to its bottom edge 658 and aligned with the bottom apertures 720 of the head support member 510, the second sidewall 620 has a plurality of bottom edge apertures located proximate to its bottom edge 658 and aligned with the bottom apertures 720 of the first side support member 530, the third sidewall 630 has a plurality of bottom edge apertures located proximate to its bottom edge 658 and aligned with the bottom apertures 720 of the foot support member, and the fourth sidewall 640 has a plurality of bottom edge apertures located proximate to its bottom edge 658 and aligned with the bottom apertures 720 of the second side support member 540. The first sidewall 610 is further secured to the frame 10 by placing its bottom edge 658 between the lower horizontal support member 140 of the head subframe 100 and the head support member 510 of the mattress support component 500 such that the bottom fasteners 740 placed within the aligned bottom apertures 720 of the lower horizontal support member 140 of the head subframe 100 and the head support member 510 of the mattress support component 500 pass through the bottom edge apertures of the first sidewall 610. In a similar manner the bottom edges 658 of the remaining sidewalls 620,630,640 are placed between corresponding pairs of lower horizontal support members 240, 340,440 and lateral support members, with bottom fasteners 740 passing through the bottom edge apertures of the sidewalls 620,630,640. See FIG. 4B. The sidewalls 610,620,630, 640 may further comprise a plurality of grommets 670, with the grommets 670 located within the bottom edge apertures, one grommet 670 per aperture. Thus, the bottom edges 658 of the sidewalls 610,620,630,640 are sandwiched between corresponding pairs of lower horizontal support members and lateral support members, with the bottom fasteners 740 placed through the bottom edge apertures of the sidewalls 610,620,630,640 to prevent slippage. In yet another embodiment the lower horizontal support members 140,240, 340,440 and lateral support members 510,530, 540 may comprise indentations on their adjacent surfaces at the bottom apertures 720 to accommodate the grommets 670, allowing an even tighter fit between the paired lower horizontal support members 140,240,340,440 and lateral support members 510,530, 540.

Modifications and variations may be made to the disclosed embodiments of the present invention without departing from the subject or spirit of the present invention as defined in the following claims.

I claim:

1. A bed enclosure comprising a frame;

a mattress support component, said mattress support component supported by the frame;

four sidewalls, designated first sidewall, second sidewall, third sidewall, and fourth sidewall, each of said sidewalls removably attached to the frame;

a sleeping space, said sleeping space formed by and partially enclosed by the frame, sidewalls, and mattress support component, with the sleeping space having a bottom defined by the mattress support component, four substantially vertical sides defined by the sidewalls, and an open top, with said sleeping space being suitably adapted to accommodate a bed mattress placed upon the mattress support component; and an access mechanism, said access mechanism integrated into at least one sidewall and comprising at least one closable aperture, with each said closable aperture having an open state and a closed state, whereby each said closable aperture is suitably adapted to allow a person to access and to enter into or exit the sleeping space when said closable aperture is in the open state and to prevent a person from accessing or entering into or exiting the sleeping space when said closable aperture is in the closed state;

wherein the frame comprises an attachment component;

a head subframe, said head subframe having a width;

a foot subframe, said foot subframe being substantially the same size and shape as the head subframe;

a first side subframe, said first side subframe having a width greater than the width of the head subframe; and a second side subframe, said second side subframe being substantially the same size and shape as the first side subframe;

whereby the head subframe is oriented substantially parallel to and opposite the foot subframe, the first side subframe is oriented substantially parallel to and opposite the second side subframe, the head subframe is oriented substantially perpendicular to the first and second side subframes, the foot subframe is oriented substantially perpendicular to the first and second side subframes, the head subframe is removably attached to the first side subframe by the attachment component, the head subframe is removably attached to the second side subframe by the attachment component, the foot subframe is removably attached to the first side subframe by the attachment component, and the foot subframe is removably attached to the second side subficame by the attachment component; and each of the head subframe, foot subframe, first side subframe, and second side subframe comprises a first vertical support member, said first vertical support member having an upper end, a lower end, a connection point, and a height, said connection point being located along said first vertical support member between the upper end and the lower end of said first vertical support member and closer to the lower end than to the upper end at a distance D from the lower end of said first vertical support member, a second vertical support member, said first vertical support member having an upper end, a lower end, a connection point, and a height, said height being substantially the same as the height of the first vertical support member and said connection point located along said second vertical support member substantially corresponding to the location of the connection point of the first vertical support member, an upper horizontal support member, said upper horizontal support member having a first end, a second end, and a length, and a lower horizontal support member, said lower horizontal support member having a first end, a second end, a top edge, and a length, said length being substantially the same as the length of the upper horizontal support member;

with the first end of the upper horizontal support member fixedly attached to the upper end of the first vertical support member, the second end of the upper horizontal support member fixedly attached to the upper end of the second vertical support member, the first end of the lower horizontal support member fixedly attached to the connection point of the first vertical support member, and the second end of the lower horizontal support member fixedly attached to the connection point of the second vertical support member, whereby the top edge of the lower horizontal support member is oriented upward; and the attachment component comprises a plurality of side apertures formed through the first and second vertical support members of each of the subframes, each said side aperture having a substantially cylindrical inside diameter, with each said side aperture oriented substantially perpendicular to a longitudinal axis of the vertical support member into which it is formed, wherein the side apertures formed into the first vertical support member of the head subframe are aligned with the side apertures formed into the second vertical support member of the first side subframe, said aligned side apertures collectively designated first corner apertures, the side apertures formed into the first vertical support member of the first side subframe are aligned with the side apertures formed into the second vertical support member of the foot subframe, said aligned side apertures collectively designated second corner apertures, the side apertures formed into the first vertical support member of the foot subframe are aligned with the side apertures formed into the second vertical support member of the second side subframe, said aligned side apertures collectively designated third corner apertures, and the side apertures formed into the first vertical support member of the second side subframe are aligned with the side apertures formed into the second vertical support member of the head subframe, said aligned side apertures collectively designated fourth corner apertures; and a plurality of side fasteners, each said side fastener suitably adapted to be positioned at least partially within a pair of aligned side apertures formed into adjacent vertical support members and suitably adapted to removably secure said pair of adjacent vertical support members to each other; and each of said sidewalls is comprised of a flexible material, and for each sidewall said sidewall has a first vertical edge, a second vertical edge, a top edge, a bottom edge, a plurality of first edge apertures located proximate to said first vertical edge, and a plurality of second edge apertures located proximate to said second vertical edge;

wherein the first edge apertures of the first sidewall are aligned with the first corner apertures and the first vertical edge of the first sidewall is placed between the first vertical support member of the head subframe and the second vertical support member of the first side subframe, such that side fasteners placed within the first corner apertures pass through the first edge apertures of the first sidewall thereby removably securing the first vertical edge of the first sidewall to the frame;

the second edge apertures of the first sidewall are aligned with the fourth corner apertures and the second vertical edge of the first sidewall is placed between the second vertical support member of the head subframe and the first vertical support member of the second side subframe, such that side fasteners placed within the fourth corner apertures pass through the second edge apertures of the first sidewall thereby removably securing the second vertical edge of the first sidewall to the frame;

the first edge apertures of the second sidewall are aligned with the second corner apertures and the first vertical edge of the second sidewall is placed between the first vertical support member of the first side subframe and the second vertical support member of the foot subframe, such that side fasteners placed within the second corner apertures pass through the first edge apertures of the second sidewall thereby removably securing the first vertical edge of the second sidewall to the frame;

the second edge apertures of the second sidewall are aligned with the first corner apertures and the second vertical edge of the second sidewall is placed between the first vertical support member of the head subframe and the second vertical support member of the first side subframe, such that side fasteners placed within the first corner apertures pass through the second edge apertures of the second sidewall thereby removably securing the second vertical edge of the second sidewall to the frame;

the first edge apertures of the third sidewall are aligned with the third corner apertures and the first vertical edge of the third sidewall is placed between the first vertical support member of the foot subframe and the second vertical support member of the second side subframe, such that side fasteners placed within the third corner apertures pass through the first edge apertures of the third sidewall thereby removably securing the first vertical edge of the third sidewall to the frame;

the second edge apertures of the third sidewall are aligned with the second corner apertures and the second vertical edge of the third sidewall is placed between the first vertical support member of the first side subframe and the second vertical support member of the foot subframe, such that side fasteners placed within the second corner apertures pass through the second edge apertures of the third sidewall thereby removably securing the second vertical edge of the third sidewall to the frame;

the first edge apertures of the fourth sidewall are aligned with the fourth corner apertures and the first vertical edge of the fourth sidewall is placed between the second vertical support member of the head subframe and the first vertical support member of the second side subframe, such that side fasteners placed within the fourth corner apertures pass through the first edge apertures of the fourth sidewall thereby removably securing the first vertical edge of the fourth sidewall to the frame; and the second edge apertures of the fourth sidewall are aligned with the third corner apertures and the second vertical edge of the fourth sidewall is placed between the first vertical support member of the foot subframe and the second vertical support member of the second side subframe, such that side fasteners placed within the third corner apertures pass through the second edge apertures of the fourth sidewall thereby removably securing the second vertical edge of the fourth sidewall to the frame.

2. The bed enclosure of claim 1 wherein the top edge of the first sidewall is removably attached to the upper horizontal support member of the head subframe, the top edge of the second sidewall is removably attached to the upper horizontal support member of the first side subframe, the top edge of the third sidewall is removably attached to the upper horizontal support member of the foot subframe, and the top edge of the fourth sidewall is removably attached to the upper horizontal support member of the second side subframe.

3. The bed enclosure of claim 1 wherein the bottom edge of the first sidewall is removably attached to the lower horizontal support member of the head subframe, the bottom edge of the second sidewall is removably attached to the lower horizontal support member of the first side subframe, the bottom edge of the third sidewall is removably attached to the lower horizontal support member of the foot subframe, and the bottom edge of the fourth sidewall is removably attached to the lower horizontal support member of the second side subframe.

4. The bed enclosure of claim 1 wherein the mattress support component comprises a head support member, said head support member being substantially elongate and substantially planer and having a substantially uniform thickness, and having a top edge and a plurality of bottom apertures disposed along the head support member, a foot support member, said foot support member being substantially elongate and substantially planer and having a substantially uniform thickness, and having a top edge and a plurality of bottom apertures disposed along the foot support member, a first side support member, said first side support member being substantially elongate and substantially planer and having a substantially uniform thickness, and having a top edge and a plurality of bottom apertures disposed along the first side support member, a second side support member, said second side support member being substantially elongate and substantially planer and having a substantially uniform thickness, and having a top edge and a plurality of bottom apertures disposed along the second side support member, and a mattress support surface, said mattress support surface being substantially planar and having a width, said width being just slightly less than the length of the lower horizontal support member of the head subframe;

the head subframe has a plurality of bottom apertures disposed along its lower horizontal support member such that said bottom apertures align with the bottom apertures of the head support member;

the foot subframe has a plurality of bottom apertures disposed along its lower horizontal support member such that said bottom apertures align with the bottom apertures of the foot support member;

the first side subframe has a plurality of bottom apertures disposed along its lower horizontal support member such that said bottom apertures align with the bottom apertures of the first side support member;

the second side subframe has a plurality of bottom apertures disposed along its lower horizontal support member such that said bottom apertures align with the bottom apertures of the second side support member;

the first sidewall has a plurality of bottom edge apertures located proximate to the bottom edge of the first sidewall such that said bottom edge apertures of the first sidewall align with the bottom apertures of the head support member;

the second sidewall has a plurality of bottom edge apertures located proximate to the bottom edge of the second sidewall such that said bottom edge apertures of the second sidewall align with the bottom apertures of the first side support member;

the third sidewall has a plurality of bottom edge apertures located proximate to the bottom edge of the third sidewall such that said bottom edge apertures of the third sidewall align with the bottom apertures of the foot support member; and the fourth sidewall has a plurality of bottom edge apertures located proximate to the bottom edge of the fourth sidewall such that said bottom edge apertures of the fourth sidewall align with the bottom apertures of the second side support member;

wherein the head support member is removably attached along the lower horizontal support member of the head subframe and interior to the lower horizontal support member of the head subframe by a plurality of bottom fasteners inserted into the bottom apertures of the head support member and into the bottom apertures of the lower horizontal support member of the head subframe, with the top edge of the head support member being oriented substantially horizontally, and with the bottom edge of the first sidewall placed between the head support member and the lower horizontal support member of the head subframe such that said bottom fasteners pass through the bottom edge apertures of the first sidewall thereby removably securing the bottom edge of the first sidewall to the frame;

the first side support member is removably attached along the lower horizontal support member of the first side subframe and interior to the lower horizontal support member of the first side subframe by a plurality of bottom fasteners inserted into the bottom apertures of the first side support member and into the bottom apertures of the lower horizontal support member of the first side subframe, with the top edge of the first side support member being oriented substantially horizontally, and with the bottom edge of the second sidewall placed between the first side support member and the lower horizontal support member of the first side subframe such that said bottom fasteners pass through the bottom edge apertures of the second sidewall thereby removably securing the bottom edge of the second sidewall to the frame;

the foot support member is removably attached along the lower horizontal support member of the foot subframe and interior to the lower horizontal support member of the foot subframe by a plurality of bottom fasteners inserted into the bottom apertures of the foot support member and into the bottom apertures of the lower horizontal support member of the foot subframe, with the top edge of the foot support member being oriented substantially horizontally, and with the bottom edge of the third sidewall placed between the foot support member and the lower horizontal support member of the foot subframe such that said bottom fasteners pass through the bottom edge apertures of the third sidewall thereby removably securing the bottom edge of the third sidewall to the frame; and the second side support member is removably attached along the lower horizontal support member of the second side subframe and interior to the lower horizontal support member of the second side subframe by a plurality of bottom fasteners inserted into the bottom apertures of the second side support member and into the bottom apertures of the lower horizontal support member of the second side subframe, with the top edge of the second side support member being oriented substantially horizontally, and with the bottom edge of the fourth sidewall placed between the second side support member and the lower horizontal support member of the second side subframe such that said bottom fasteners pass through the bottom edge apertures of the fourth sidewall thereby removably securing the bottom edge of the fourth sidewall to the frame;

whereby the mattress support surface may be placed onto at least a portion of the top edges of at least two of the following group: the head support member, the foot support member, the first side support member, and the second side support member.

* * * * *